US009435237B2

(12) United States Patent
Yacoub

(10) Patent No.: US 9,435,237 B2
(45) Date of Patent: Sep. 6, 2016

(54) EXHAUST-GAS AFTERTREATMENT SYSTEM

(71) Applicant: Ford Global Technologies, LLC, Dearborn, MI (US)

(72) Inventor: Yasser Mohamed sayed Yacoub, Cologne (DE)

(73) Assignee: Ford Global Technologies, LLC, Dearborn, MI (US)

( * ) Notice: Subject to any disclaimer, the term of this patent is extended or adjusted under 35 U.S.C. 154(b) by 720 days.

(21) Appl. No.: 13/651,113

(22) Filed: Oct. 12, 2012

(65) Prior Publication Data

US 2013/0101471 A1 Apr. 25, 2013

(30) Foreign Application Priority Data

Oct. 24, 2011 (DE) ..... 10 2011 085086

(51) Int. Cl.

| | |
|---|---|
| ***F01N 3/00*** | (2006.01) |
| ***F01N 3/023*** | (2006.01) |
| ***F01N 3/10*** | (2006.01) |
| ***F01N 3/027*** | (2006.01) |
| ***F01N 13/00*** | (2010.01) |

(52) U.S. Cl.

CPC ..... *F01N 3/023* (2013.01); *F01N 3/027* (2013.01); *F01N 3/103* (2013.01); *F01N 13/011* (2014.06); *F01N 13/017* (2014.06)

(58) Field of Classification Search

USPC ..... 60/274, 286, 287, 289, 292, 295, 297, 60/303, 311

See application file for complete search history.

(56) References Cited

U.S. PATENT DOCUMENTS

| | | | | |
|---|---|---|---|---|
| 4,535,589 | A * | 8/1985 | Yoshida | F01N 3/027 219/205 |
| 5,067,319 | A | 11/1991 | Moser | |
| 7,322,186 | B2 * | 1/2008 | Tochikawa | F01N 3/023 60/297 |
| 7,370,474 | B2 * | 5/2008 | Minami | F01N 3/0231 60/286 |
| 7,421,839 | B2 * | 9/2008 | Igarashi | 60/297 |
| 7,550,119 | B2 * | 6/2009 | Kojima | 422/180 |
| 7,799,289 | B2 * | 9/2010 | Robel | F01N 3/0231 422/180 |
| 7,908,844 | B2 * | 3/2011 | Kamoshita et al. | 60/286 |
| 7,984,608 | B2 * | 7/2011 | Roozenboom | 60/285 |
| 8,608,835 | B2 * | 12/2013 | Busch | 95/287 |
| 8,673,064 | B2 * | 3/2014 | Ahmed et al. | 95/273 |
| 8,986,636 | B2 * | 3/2015 | Hartland | B01D 53/9477 423/213.2 |

FOREIGN PATENT DOCUMENTS

| | | | | |
|---|---|---|---|---|
| DE | 69503203 | T2 | 1/1999 | |
| DE | 102004049511 | A1 | 4/2006 | |
| DE | 102005019466 | A1 | 11/2006 | |
| DE | 102009000804 | A1 | 8/2010 | |
| DE | 102009029259 | A1 | 3/2011 | |
| EP | 0717177 | A2 | 11/1995 | |
| FR | 2880914 | A1 | 7/2006 | |
| JP | H03294614 | A | 12/1991 | |
| JP | 407279646 | * | 4/1994 | 60/295 |
| JP | H07279646 | A | 10/1995 | |

* cited by examiner

*Primary Examiner* — Binh Q Tran

(74) *Attorney, Agent, or Firm* — Julia Voutyras; Alleman Hall McCoy Russell & Tuttle LLP

(57) ABSTRACT

The present disclosure relates to an exhaust-gas aftertreatment system for an internal combustion engine, having an exhaust line and having provided therein a filter arrangement which comprises a first particle filter element and a second particle filter element, wherein the first particle filter element is equipped with an active regeneration device for restoring its filtration performance. The disclosure furthermore relates to a method for operating an exhaust-gas aftertreatment system of said type and to the use thereof.

20 Claims, 4 Drawing Sheets

EXHAUST-GAS AFTERTREATMENT SYSTEM

CROSS REFERENCE TO RELATED APPLICATIONS

The present application claims priority to German Patent Application No. 102011085086.4, filed on Oct. 24, 2011, the entire contents of which are hereby incorporated by reference for all purposes.

TECHNICAL FIELD

The present disclosure relates to exhaust gas aftertreatment for diesel engines.

BACKGROUND AND SUMMARY

The lean operation and relatively cool operating temperatures of diesel engines create an environment where incomplete combustion produces particle emissions and soot build up that necessitates exhaust-gas aftertreatment including particle filters. This can also be true of direct injected spark ignition engines. This is especially the case with turbocharged engines that have higher NOx emissions. Exhaust-gas recirculation combats the higher NOx emissions but at the expense of soot production. More efficient particle filtration could provide both minimized particle emissions and maximized energy efficiency by reducing backpressure through the filtration device.

DE 40 04 424 A1 discloses a device for purification of the exhaust gases of diesel engines, in which device, the exhaust line of the engine is divided into two branch lines which can be alternately shut off by means of a switching device and one of which leads through a soot filter. Downstream of the branch line containing the soot filter, the other branch line, which serves as a bypass line, merges again to form an end line. The branch line that leads through the soot filter is opened above a predetermined partial engine load value, as well as at full engine load, by means of the switching device, which can be actuated as a function of the engine load. To be able to ensure practically complete purification of the exhaust gases, an oxidation catalytic converter is installed downstream of the switching device in the bypass line or in the end line. If the oxidation catalytic converter is installed in the end line, all of the exhaust gas flows through it.

DE 10 2004 049 511 A1 is concerned with a semi-active heat-exchanging silencer, downstream of which is positioned a catalytic converter. In order to prevent heat losses from the exhaust gases after starting of the internal combustion engine and to effect heat losses when the engine is at operating temperature, via a compact component, two different flow paths are provided in the silencer. One of said flow paths is of heat-insulated design whereas the other flow path is designed such that the exhaust gases are cooled.

DE 10 2005 019 466 A1 in turn discloses a diesel particle filter for an exhaust system of an internal combustion engine, said diesel particle filter having at least one housing and at least one filter body. The filter device comprises at least two filter bodies arranged fluidically in series. The filter bodies are arranged spaced apart from one another in a common housing. Between the filter bodies there are provided chambers into each of which externally connected lines open out.

Exhaust-gas aftertreatment devices in the form of particle filters or soot filters require periodic regeneration through burn-off of the captured soot particles. To be able to perform the regeneration, the exhaust-gas temperature is raised to a value above, for example, 550° C. in order to initiate the combustion of the captured soot particles. In the case of lean-burn internal combustion engines, for example, diesel engines, said temperature levels are attained during normal operation of the internal combustion engine under full load if the soot filter is in a close-coupled arrangement. Close-coupled means that the soot or particle filter is arranged so close to an exhaust-gas outlet of the internal combustion engine that heat losses of the exhaust gases are minimized, but also that a desired passive regeneration is attained. Since the soot filter is arranged very close to the exhaust-gas outlet where there is little installation space available, design parameters, that is to say the size and capacity of the soot filter, are restricted. Furthermore, the configuration of the exhaust lines (cones, bends) may lead to a sub-optimal flow distribution. This causes a considerable pressure drop across the soot filter resulting in high throughflow rates, which has an adverse effect on the fuel consumption of the internal combustion engine, in particular during, so-called, highway driving.

To, at least partially, eliminate said problems, DE 10 2009 029 259 A1 proposes an exhaust-gas aftertreatment system of the type mentioned in the technical field. In said exhaust-gas aftertreatment system, within a first soot filter, there is arranged a passage line which can be shut off via a control element, which is closed in the circumferential direction, is free from filter elements, and which extends all the way through the particle filter element of the first soot filter. Here, at least one second soot filter is positioned downstream of the first soot filter. It is thus the case that two soot filter elements are arranged in series in the exhaust line or in an exhaust section, such that a low pressure drop can be attained despite a high throughflow rate. Therefore, improved fuel consumption can be attained in conjunction with an increased back pressure caused by the one or more soot filters.

A disadvantage of such a system is that, with the "downsizing" of the swept volume of engines which has been increasingly pursued recently, the exhaust-gas temperature is often no longer adequate, in particular in the lower load range, to generate the exhaust-gas temperature required for the regeneration of the particle filter. At the same time, relatively high exhaust-gas temperatures, and therefore greater quantities of emissions, in particular of nitrogen oxides, are encountered in such engines at medium load and full load. To reduce nitrogen oxide emissions, increased exhaust-gas recirculation is performed, which comes at the expense of soot emissions. However, if the required regeneration temperatures of the soot particle filter are not exceeded at corresponding time intervals, the soot filters reach their capacity limit relatively quickly, and can then accommodate no further soot.

An increase in the soot accommodation capacity of such exhaust-gas aftertreatment systems by increasing the size thereof is however possible and expedient within certain limits. Firstly, this is generally associated with an increased space requirement, wherein the space availability in the under-floor region of passenger motor vehicles in particular is limited. Furthermore, this would also increase the dynamic pressure in the exhaust tract, which is likewise, acceptable within certain limits. Consequently, the exhaust-gas aftertreatment systems hitherto known from the prior art are often not capable of reducing the emissions of such engines to a satisfactory extent over the different operating states, in particular in light of the intensely fluctuating exhaust-gas temperatures and the resulting fluctuating emission profile.

It is an object of the present disclosure to modify an exhaust-gas aftertreatment system such that satisfactory exhaust-gas treatment is attained, in particular with regard to soot emissions, even in the case of engines of reduced swept volume. In one example, said object is achieved via an exhaust-gas aftertreatment system for an internal combustion engine, having an exhaust line containing a filter arrangement which comprises a first particle filter element and a second particle filter element, wherein the first particle filter element is equipped with an active regeneration device for restoring its filtration performance.

In this way, it is possible to provide particle filtration and regeneration of the particle filter element without the space constraints of a close-coupled particle filter. Additionally, because of the affixed active regeneration device on the first particle filter element, soot particle overloading can be reduced and there is no need for increased soot load capacity. The use of the two particle filter elements of the present disclosure furthermore decrease backpressure compared to a system with a single particle filter element.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
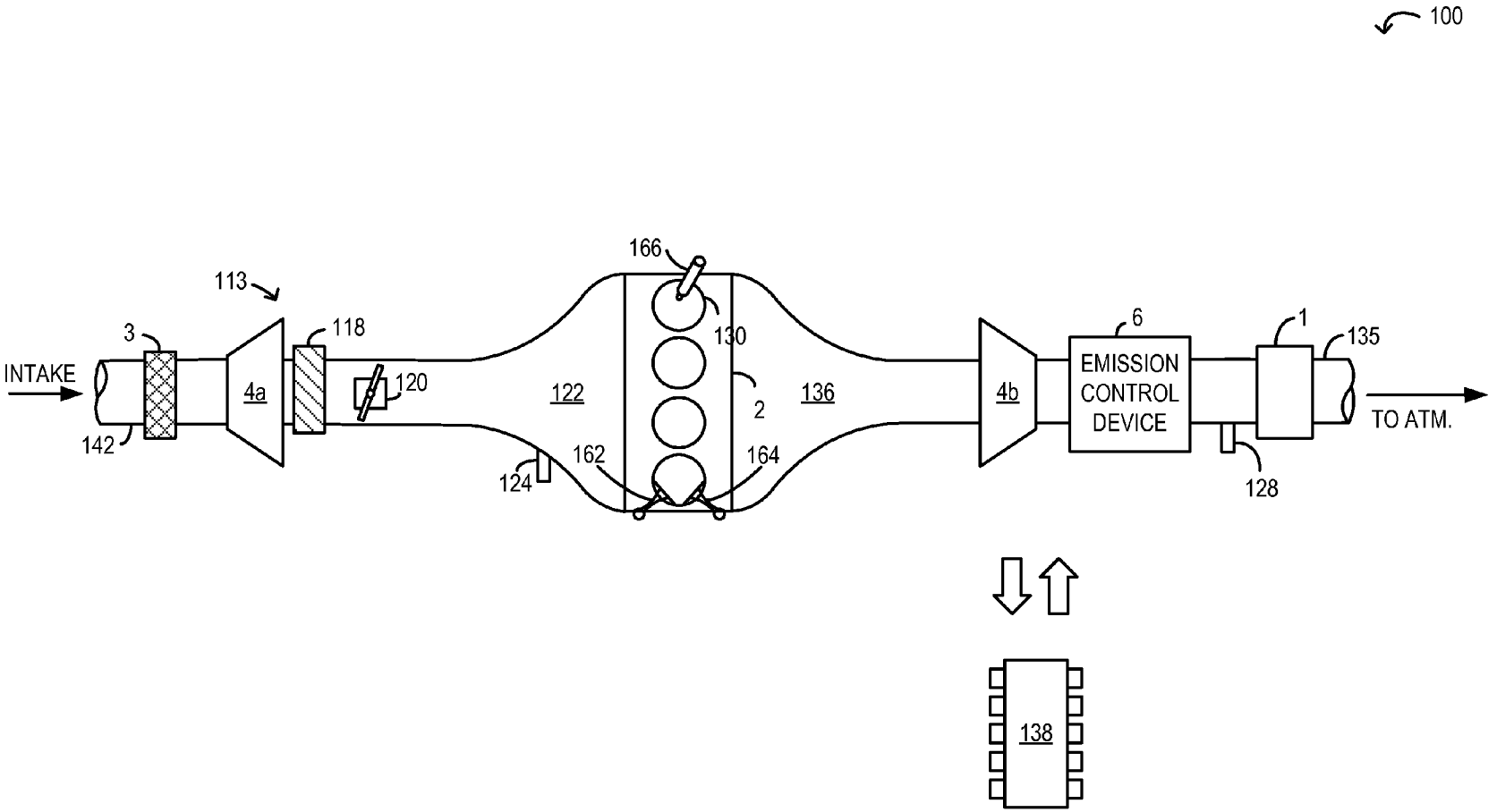
FIG. 1 schematically shows aspects of an example engine system in accordance with this disclosure.

The present disclosure is based on the realization that the abovementioned problems can be eliminated through the use of a particle filter element with an active regeneration device for restoring filtration performance. In contrast to the otherwise conventional passive particle filter elements, said actively regenerable particle filter element is not dependent on increased exhaust-gas temperatures for oxidizing the stored soot. The particle filter element can thus be regenerated even at exhaust-gas temperatures of less than 250° C. or 300° C. For this purpose, the particle filter element can be heated to above the required regeneration temperature through activation of the active regeneration device. For this purpose, the degree of loading of the first particle filter element may be estimated or measured based on engine operating conditions such as air-fuel ratio and exhaust-gas temperature. When a predetermined degree of soot loading has been reached, the regeneration device is activated and the particle filter is thereby regenerated. Aside from the above-described regeneration device, it is possible in principle for any particle filter to be used for the first particle filter element.

A further advantage is that the first particle filter element does not require such a high storage capacity because it can be actively regenerated at all times. Consequently, the first particle filter element can be of smaller dimensions than the second particle filter element. Specifically, in the case of such an embodiment, the maximum soot loading density of the first particle filter element may be at least 10% by weight lower, and in particular at least 20% by weight lower with respect to the soot quantity, than that of the second particle filter element.

The active regeneration device may be formed, for example, by an electric heating device or else also comprise known measures of the internal combustion engine such as engine-internal post-injection and/or direct fuel injection into the exhaust tract.

In a further embodiment of the exhaust-gas aftertreatment system according to the disclosure, a control element is provided therein, said control element being designed such that, by means thereof, the exhaust-gas flow can be conducted selectively through the first particle filter element, through the second particle filter element or through the first and second particle filter elements simultaneously. In this way, it is possible, through connection to the engine controller, for the exhaust-gas flow to be conducted selectively through the two particle filter elements. The control element may be for example a motor-actuable or pneumatically actuable flap or a valve. By means of the control element, it is furthermore likewise possible at high exhaust-gas temperatures for the exhaust-gas flow to be conducted through both particle filter elements, and to thereby also "passively" regenerate the actively regenerable particle filter element.

Here, the control element may particularly preferably be switched in a continuously variable fashion between a closed and an open position with respect to the first particle filter element. In this way, it is possible to realize highly variable control of the exhaust-gas flow through the two particle filter elements in order to ensure as optimum an elimination of soot as possible under all operating conditions and at all exhaust-gas temperatures.

Within the context of the present disclosure, the control element may be arranged upstream or downstream of the first and second particle filter elements. The control element is preferably situated at a pipe switch of the exhaust line, for example at a Y-shaped pipe switch. Here, one limb of the Y-shaped pipe switch constitutes the exhaust-gas inflow or exhaust-gas outflow, whereas the two other limbs form the inflows or outflows of the first and second particle filter elements.

In one particularly preferred embodiment of the exhaust-gas aftertreatment system according to the disclosure, the first particle filter element and the second particle filter element are connected in parallel with one another. This may be realized in numerous ways. For example, the exhaust line may have a Y-type pipe switch through which an exhaust-gas partial flow, or a fraction from 0 to 100% of the exhaust-gas volume flow, apportioned by means of the optional control element, is conducted to each of the particle filter elements. Here, the two particle filter elements are situated in separate housings and are fastened separately from one another, for example, under the vehicle floor.

As an alternative to the embodiment described above, the two particle filter elements may also be arranged in the same housing, wherein the exhaust-gas volume flow is variably apportioned to the particle filter elements, preferably by means of a control element. Here, the control element is arranged preferably so as to regulate the exhaust-gas flow through the first particle filter element alone. That is to say, here, there is a continuous exhaust-gas flow through the second particle filter element.

In a refinement of the exhaust-gas aftertreatment system according to the disclosure, the second particle filter element is a passive particle filter element which can be regenerated by means of exhaust-gas temperatures of 500° C. or higher. Such particle filters are known to a person skilled in the art.

The exhaust-gas aftertreatment system according to the disclosure may also have further exhaust-gas purification devices in addition to the two particle filter elements. For example, the exhaust-gas aftertreatment system may comprise at least one exhaust-gas aftertreatment device selected from oxidation catalytic converter, NOx catalytic converter and selective catalytic reduction (SCR) catalytic converter, wherein the exhaust-gas aftertreatment device is arranged, preferably, upstream of the first and second particle filter elements. Such exhaust-gas aftertreatment devices are known to a person skilled in the art.

A further subject matter of the present disclosure relates to a method for exhaust-gas aftertreatment by means of an exhaust-gas aftertreatment system for an internal combustion engine, which exhaust-gas aftertreatment system comprises an exhaust line and has provided therein a filter arrangement which has a first particle filter element and a second particle filter element, wherein the filtration performance of the first particle filter element is restored by means of an active regeneration device which is assigned to the first particle filter element.

In a further embodiment of the method according to the disclosure, the regeneration device is formed by an electric heating device by which the first particle filter element, when a predefined soot loading density is reached and exhaust-gas temperatures of less than 500° C. prevail, can be heated to the required regeneration temperature, in particular to a regeneration temperature of 500° C. or higher, preferably to at least 550° C. The control of said processes may be performed by the operation controller of the engine, because the required data, such as the composition of the exhaust gas, exhaust-gas temperature and so forth, are generally present therein.

Finally, the present disclosure relates to the use of an exhaust-gas aftertreatment system according to the disclosure for the exhaust-gas aftertreatment of an internal combustion engine. An example of such an engine is depicted in FIG. 1.

FIG. 1 schematically shows aspects of an example engine system 100 including an engine 2. In the depicted embodiment, engine 2 is a boosted engine coupled to a turbocharger 113 including a compressor 4*a* driven by a turbine 4*b*. Specifically, fresh air is introduced along intake passage 142 into engine 2 via air filter 3 and flows to compressor 4*a*. A flow rate of ambient air that enters the intake system through intake air passage 142 can be controlled at least in part by adjusting throttle 120. Compressor 4*a* may be any suitable intake-air compressor, such as a motor-driven or driveshaft driven supercharger compressor. In engine system 2, however, the compressor is a turbocharger compressor mechanically coupled to turbine 4*b*, the turbine 4*b* driven by expanding engine exhaust.

As shown in FIG. 1, compressor 4*a* is coupled, through charge-air cooler 118 to throttle valve 120. Throttle valve 120 is coupled to engine intake manifold 122. From the compressor, the compressed air charge flows through the charge-air cooler and the throttle valve to the intake manifold. The charge-air cooler may be an air-to-air or air-to-water heat exchanger, for example. In the embodiment shown in FIG. 1, the pressure of the air charge within the intake manifold is sensed by manifold absolute pressure (MAP) sensor 124.

Intake manifold 122 is coupled to a series of combustion chambers 130 through a series of intake valves (not shown). The combustion chambers are further coupled to exhaust manifold 136 via a series of exhaust valves (not shown). In the depicted embodiment, a single exhaust manifold 136 is shown.

Combustion chambers 130 may be supplied one or more fuels, such as gasoline, alcohol fuel blends, diesel, biodiesel, compressed natural gas, etc. Each cylinder 130 may be serviced by one or more valves. In the present example, each cylinder 130 includes a corresponding intake valve 162 and an exhaust valve 164. Fuel is supplied to the combustion chambers 130 via injector 166.

In the depicted example, fuel injector 166 is configured for direct injection though in other embodiments, fuel injector 166 may be configured for port injection or throttle valve-body injection. Further, each combustion chamber may include one or more fuel injectors of different configurations to enable each cylinder to receive fuel via direct injection, port injection, throttle valve-body injection, or combinations thereof. In the combustion chambers, combustion may be initiated via spark ignition and/or compression ignition.

Exhaust from exhaust manifold 136 is directed to turbine 4*b* to drive the turbine. When reduced turbine torque is desired, some exhaust may be directed instead through a waste gate (not shown), bypassing the turbine. The combined flow from the turbine and the waste gate then flows through emission control device 6. In general, one or more emission control devices 6 may include one or more exhaust aftertreatment catalysts configured to catalytically treat the exhaust flow, and thereby reduce an amount of one or more substances in the exhaust flow. For example, one exhaust aftertreatment catalyst may be configured to trap NO from the exhaust flow when the exhaust flow is lean, and to reduce the trapped $NO_x$ when the exhaust flow is rich. In other examples, an exhaust aftertreatment catalyst may be configured to disproportionate $NO_x$ or to selectively reduce $NO_x$ with the aid of a reducing agent. In still other examples, an exhaust after-treatment catalyst may be configured to oxidize residual hydrocarbons and/or carbon monoxide in the exhaust flow. Exhaust line 135 may continue on to additional exhaust-gas aftertreatment system 1. Exhaust-gas temperature sensor 128 provides input on temperature of exhaust-gas in exhaust line 135 to controller 138. Exhaust-gas flow to additional exhaust-gas aftertreatment may be controlled, dependent on operating conditions, such as exhaust gas temperature, by controller 138. The exhaust-gas aftertreament that is the subject of the present disclosure will be discussed below.

Variations to the above engine need not be excluded from use with the exhaust-gas aftertreatment device of the present disclosure. For example, in another embodiment, engine 2 does not include a turbocharger.

Figure 2:
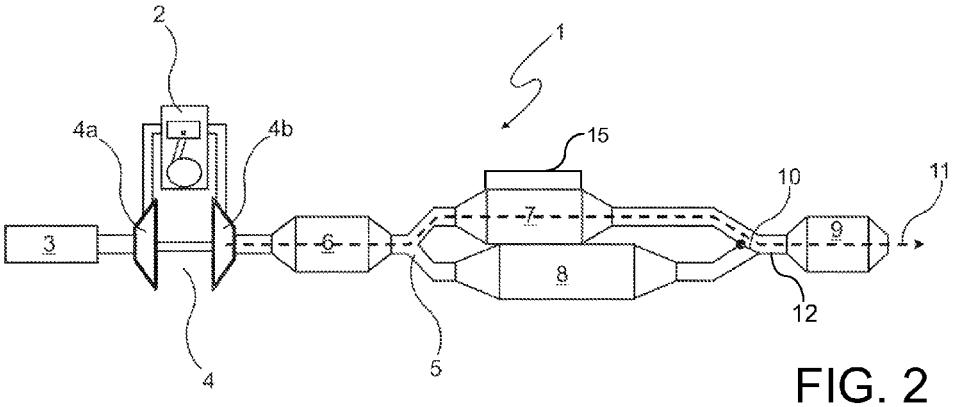
FIG. 2 shows a first embodiment of an exhaust-gas aftertreatment system according to the disclosure in a first operating state.

Referring now to FIG. 2, the drawing schematically illustrates the layout of a diesel engine with connected exhaust-gas aftertreatment system 1. The system comprises a reciprocating-piston engine 2 in the form of a diesel engine with turbocharging, which diesel engine draws in fresh air on its intake side via an air filter 3, said fresh air being pre-compressed by a compressor 4*a* of a turbocharger 4. The compressor 4*a* of the turbocharger 4 is driven by the turbine 4*b* thereof, which is at the exhaust-gas side, via a common shaft.

The combustion gases of the reciprocating-piston engine 2 are discharged through an exhaust line 5 composed of multiple pipe segments. Arranged in the exhaust line 5 downstream of the turbocharger 4 is an oxidation catalytic converter 6, at the outlet side of which in the downstream direction a Y-shaped pipe is situated in the exhaust line 5. The two particle filter elements 7, 8 are thus connected in parallel with one another in the present embodiment.

The first particle filter element 7 is equipped with an active regeneration device 15. Active regeneration device 15 could be, for example, an electric heating device for restoring the filtration performance of said first particle filter element. When a predefined soot loading density is reached and exhaust-gas temperatures of less than 500° C. prevail, first particle filter element 7 can be heated to the required regeneration temperature, for example to a regeneration temperature of 500° C. or higher.

Figure 3:
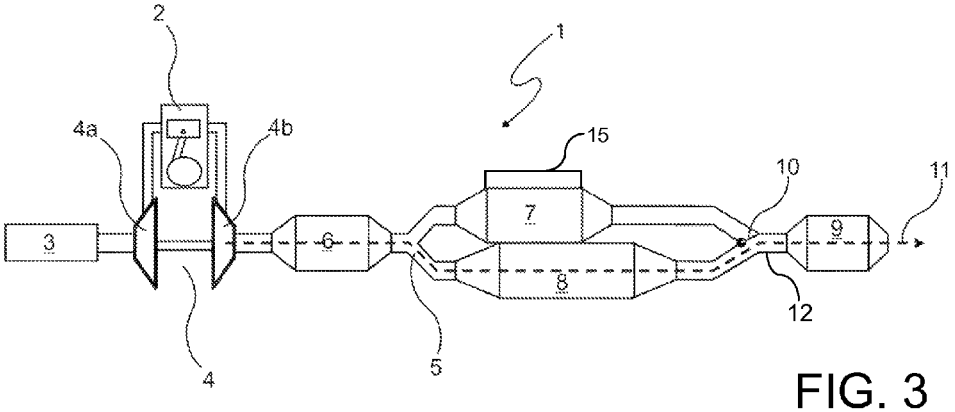
FIG. 3 shows the exhaust-gas aftertreatment system from FIG. 2 in a second operating state.
Figure 4:
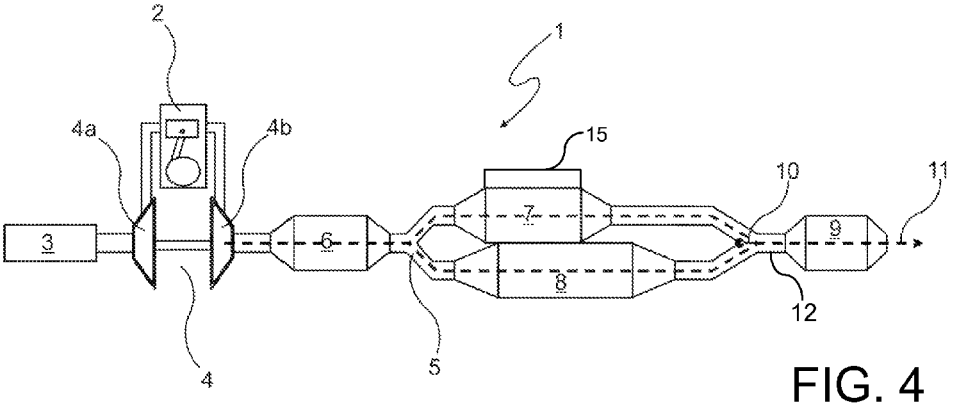
FIG. 4 shows the exhaust-gas aftertreatment system from FIGS. 1 and 2 in a third operating state.

The first particle filter element 7 is smaller than the second particle filter element 8 and has an approximately 20% smaller soot storage capacity with respect to the weight of the soot. Furthermore, a control element 10 in the form of an electrically actuable valve is situated downstream of the first and second particle filter elements 7, 8 in the region of the Y-shaped merging of the exhaust line 12, said control element 10 being designed such that the exhaust-gas flow can be conducted selectively through the first particle filter element 7 (as shown in FIG. 2), the second particle filter element 8 (as shown in FIG. 3) or through the first and second particle filter elements 7, 8 (as shown in FIG. 4). Here, the control element 10 can be switched in a continuously variable fashion between a closed and an open position with respect to the first particle filter element. Additionally, in the present embodiment control element 10 is located downstream of the first and second particle filter elements, 7, 8. In other embodiments a control element may be located upstream of the particle filter elements 7, 8, within exhaust line 5.

Downstream of the first and second particle filter elements 7, 8, the exhaust-gas partial flows are merged again via a Y-shaped piece of the exhaust line 12 and conducted into a rear silencer 9.

In the position of the control element 10 illustrated in FIG. 2, the exhaust-gas flow, which is indicated by a dashed line 11, is conducted exclusively via the first particle filter element 7. In the second operating state illustrated in FIG. 3, the outlet of the first particle filter element 7 is closed off by the control element 10, as a result of which the exhaust-gas flow 11 flows exclusively through the second particle filter element 8. Finally, FIG. 4 shows a third operating state in which the control element 10 is situated in a central position, such that exhaust-gas flow 11 flows through both the first and the second particle filter element 7, 8.

Figure 5:
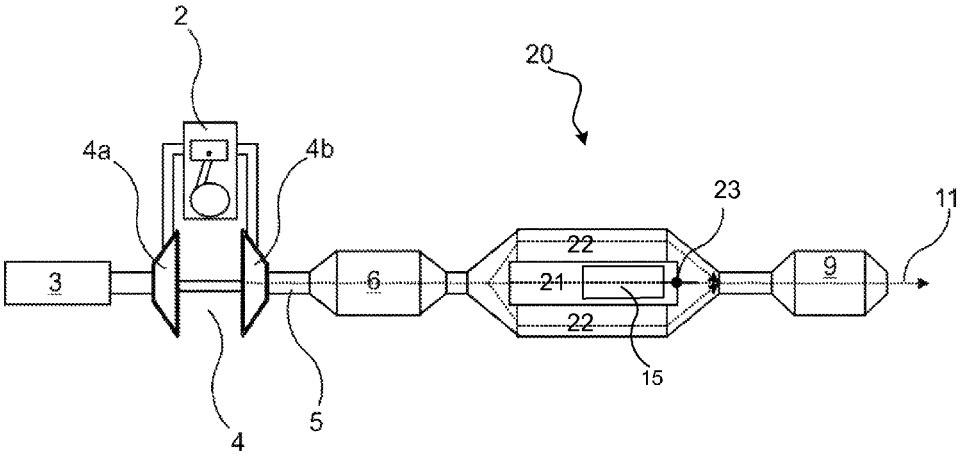
FIG. 5 shows an alternative embodiment of the exhaust-gas aftertreatment system according to the disclosure in a first operating state.

FIG. 5 illustrates an alternative embodiment of an exhaust-gas aftertreatment system 20. Said embodiment differs from the design shown in FIGS. 2 to 4 in that the first and second particle filter elements 21, 22 are situated not in separate housings but rather in the same housing. More precisely, the first particle filter element 21, and its associated active regeneration device 15, are arranged concentrically within the second particle filter element 22, wherein the control element 23 is provided at the outlet of the first particle filter element 21. The other components are identical in principle and are therefore denoted by the same reference symbols.

Figure 6:
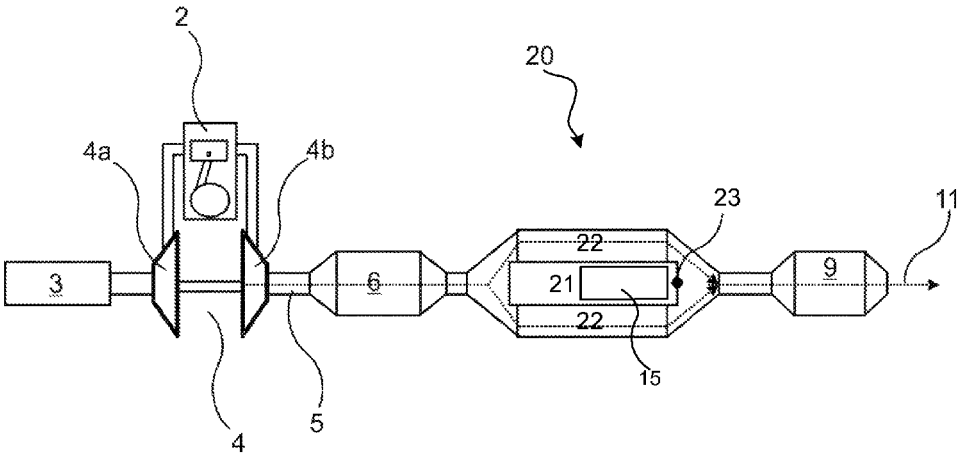
FIG. 6 shows the exhaust-gas aftertreatment system from FIG. 5 in a second operating state.

In said embodiment, depicted in FIGS. 5 and 6, the control element 23 is assigned to the first particle filter element 21, that is to say the control element 23 can regulate the exhaust-gas flow 11 which flows through the first particle filter element 21. By contrast, the exhaust-gas flow 11 flows continuously through the second particle filter element 22. In FIG. 5, the control element 23 is open, such that the exhaust-gas flow 11 flows both through the first, and through the second particle filter element 21, 22. By contrast, in FIG. 6, the control element 23 is closed, such that in this case, the exhaust-gas flow 11 flows through only the second particle filter element 22.

The above configurations of the device are non limiting and additional configurations of the two filters, one with an affixed active regeneration device are possible. For example, the first and second particle filter element could share a housing, but may not be arranged concentrically in the shared housing.

Figure 7:
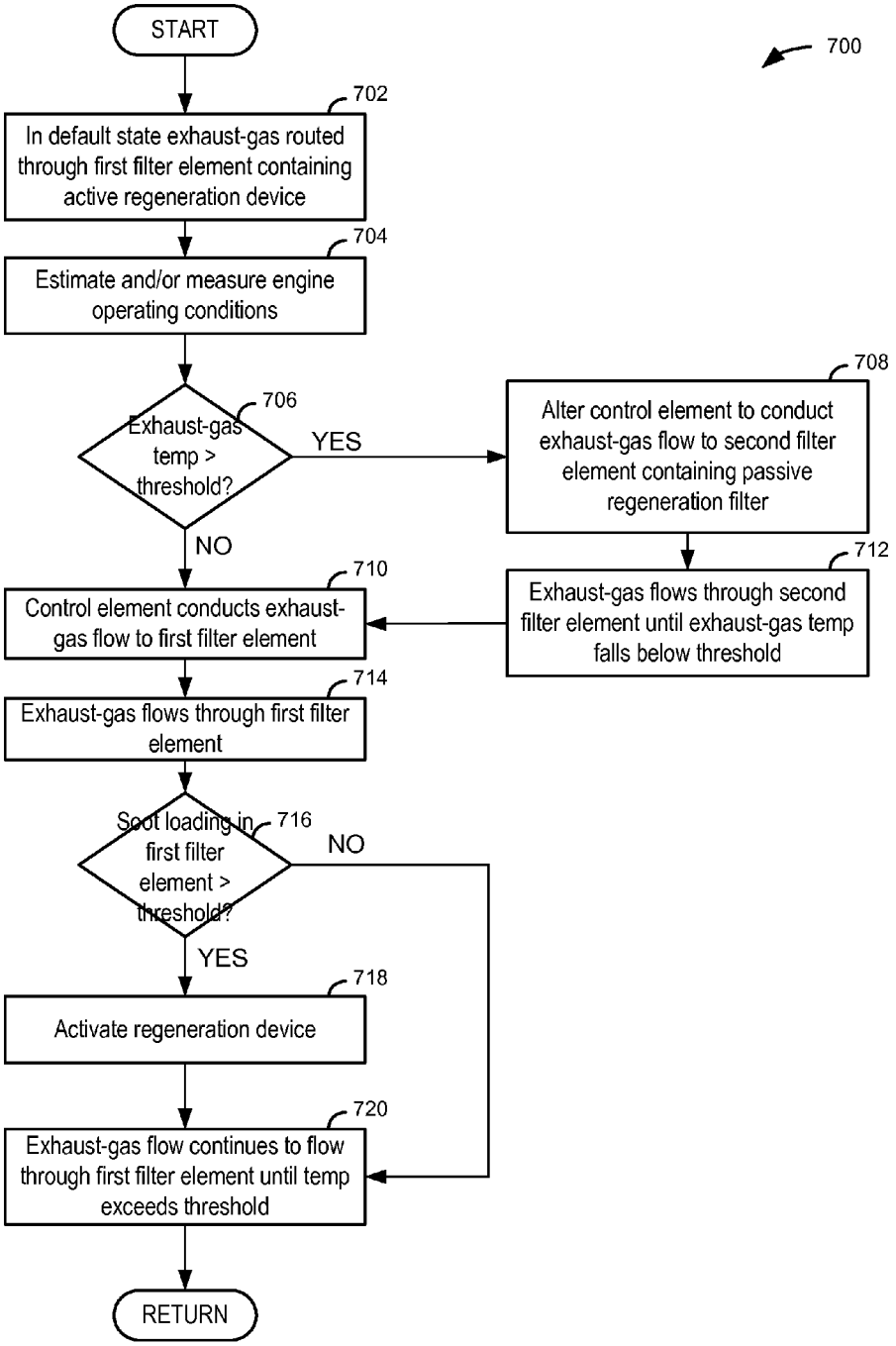
FIG. 7 schematically depicts a method by which exhaust-gas flow through the exhaust-gas aftertreatment device of the present disclosure is controlled.

Referring now to FIG. 7, the figure schematically depicts method 700, an example method by which engine controller 138 instructs the exhaust-gas aftertreament device of the present disclosure. A default state of operation for an engine containing an embodiment of the exhaust-gas aftertreatment device of the present disclosure, as depicted in FIG. 2 and FIG. 3, is for control element 10 to conduct exhaust-gas flow 11 through first particle filter element 7 containing an active regeneration device 15. This default state is depicted at 702. Engine operating conditions are estimated and/or measured at 704. Engine operating conditions can be estimated and measure based on data from manifold absolute pressure (MAP) sensor 124, load, RPM, air-fuel ratio, exhaust-gas temperature sensor 128, and others. If, at 706, the exhaust-gas temperature is above a threshold temperature based on above estimates and/or measurements (YES), method 700 proceeds to 708. The threshold temperature is a temperature, for example 500° C., above which oxidation of soot loading in a particle filter element is favored. Threshold temperature is a predefined value based on known conditions for soot oxidation. This threshold temperature is consistent for a given system, but may vary for differing systems, for example those using different catalysts. At 708 control element 10 is adjusted to conduct exhaust-gas flow to the second particle filter element 8. As depicted in FIG. 3 control element 10 is a flap valve and here closes to the fork of exhaust line 5 that contains first particle filter element 7, and is open to second particle filter element 8. At 712, exhaust-gas flow is conducted through second filter element 7 as a result of adjusted control element 10, and this exhaust-gas flow is maintained until exhaust-gas temperature falls below threshold. In this embodiment routing exhaust-gas flow through the second particle filter element 8 is done above threshold potential because this particle filter element does not contain an active regeneration device and the higher than threshold temperatures passively regenerate the second filter element.

In other embodiments control element 10 could be partially open to conduct a portion of exhaust gas flow to first filter element 7 and the remainder to second filter element 8.

This could be advantageous in conditions where back pressure from conducting exhaust-gas flow to a single particle filter element is high.

If, at 706, the exhaust-gas temperature is below threshold temperature (NO), or at 712 the temperature has fallen below threshold temperature, control element 10 retains, or adopts, its default state, wherein control element 10, a flap valve, is open to conduct exhaust-gas flow 11 through the first particle filter element 7. At 714, exhaust-gas flow 11 flows through first particle filter element 7. At temperatures below threshold, a particle filter element is unable to regenerate passively. First particle filter element 7, contains active regeneration device 15 to allow for filter element regeneration at low temperatures. At 716, soot loading in the first particle filter element 7 is monitored. If soot loading density is above a predetermined threshold at 716 (YES) active regeneration device 15 is activated, heating the first particle filter element to 500° C. or higher, preferably to at least 550° C., to regenerate first particle filter element 7 at 718. Threshold for soot loading is a level above which first particle filter element 7 becomes inefficient as its catalytic abilities are inhibited or flow through is affected by soot accumulation. Soot loading can be estimated by backpressure in exhaust manifold 136 or by long-term engine operating conditions such as air-fuel ratio and manifold absolute pressure. Variations of the above method are compatible with alternate configurations of the present disclosure. For example first particle filter element 21 and second particle filter element 22 could be arranged as shown in FIG. 5 and FIG. 6. Additionally, method 700 only includes two states of control element 10. A third state, as depicted in FIG. 4, wherein exhaust-gas flow 11, is conducted through both the first particle filter element 7 and the second particle filter element 8 simultaneously at sufficiently high temperature, is compatible with the device of the present disclosure but not shown in FIG. 7. This embodiment has the advantage of passively regenerating the first particle filter element 7 in addition to second particle filter element 8. This configuration, in which exhaust gas flow can be directed towards both filer elements simultaneously, could be advantageous to reduce high exhaust back pressure.

Additionally, the default state of the present disclosure can differ. For example, by default control element 10 might be open to both the first and second particle filter element. Therein, engine controller 38 would instruct control element 10 to direct exhaust-gas flow through the first particle filter element, the second particle filter element, or both dependent on estimates and measurements of engine operating conditions. The present disclosure provides a system for reducing particle emissions while minimizing effects on engine efficiency. The system of the present disclosure is advantageous as a larger filter is available for capturing particle emissions that can be passively generated when engine conditions produce suitably high exhaust-gas temperatures. However, as this is not necessarily the case, especially in cooler operating diesel engines and/or when operating at low loads and RPMs an additional, smaller particle filter element is provided that is coupled to an active regeneration device. The active regeneration device allows for regeneration of the catalyst of the particle filter element by providing sufficient heat to promote the oxidation of soot particles even when engine operating conditions produce exhaust-gas below this temperature.

It will be appreciated that the configurations and methods disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. An exhaust-gas aftertreatment system for an internal combustion engine, comprising:

an exhaust line;

a filter arrangement provided within the exhaust line that contains a first particle filter element with an active regeneration device configured to restore a filtration performance of the first particle filter element and a second, passive particle filter element without an active regeneration device, the first particle filter element smaller than the second particle filter element, wherein the first particle filter element and the second particle filter element are connected in parallel with one another.

2. The exhaust-gas aftertreatment system as claimed in claim 1, wherein a maximum soot loading density of the first particle filter element is at least 10% by weight lower with respect to soot quantity, than that of the second particle filter element.

3. The exhaust-gas aftertreatment systems as claimed in claim 1, wherein the first and second particle filter element are arranged in a common housing, and further comprising a control element to variably apportion exhaust-gas flow to the first and second particle filter elements.

4. The exhaust-gas aftertreatment system as claimed in claim 1, wherein the second particle filter element is regenerated by exhaust-gas temperatures of 500° C. and higher.

5. The exhaust-gas aftertreatment system as claimed in claim 1, wherein the exhaust-gas aftertreatment system comprises at least one of an oxidation catalytic converter, a NOx catalytic converter, and a selective catalytic reduction (SCR) catalytic converter arranged upstream of the parallel connection of the first and second particle filter elements.

6. The exhaust-gas aftertreatment system as claimed in claim 1, wherein the active regeneration device is formed by an electric heating device.

7. An exhaust-gas aftertreatment system for an internal combustion engine, comprising:

an exhaust line;

a filter arrangement provided within the exhaust line comprising a first particle filter element with an active regeneration device configured to restore a filtration performance of the first particle filter element and a second, passive particle filter element without an active regeneration device, the first particle filter element smaller than the second particle filter element, and the first and second particle filter elements connected in parallel downstream of an exhaust aftertreatment catalyst; and a control element provided in the exhaust-gas aftertreatment system, said control element conducting exhaust-gas flow selectively through the first particle filter element, through the second particle filter element or through the first and second particle filter elements.

8. The exhaust-gas aftertreatment system as claimed in claim 7, wherein the control element is switched, in a continuously variable fashion, between a closed and an open position with respect to the first particle filter element, and wherein when the control element is in the open position, a downstream end of the first particle filter element is coupled with a downstream end of the second particle filter element and an upstream end of the first particle filter element is coupled with an upstream end of the second particle filter element.

9. The exhaust-gas aftertreatment system as claimed in claim 7, wherein the control element is arranged upstream of the first and second particle filter elements, wherein a downstream end of the first particle filter element is coupled with a downstream end of the second particle filter element, and wherein when the control element is open, an upstream end of the first particle filter element is coupled with an upstream end of the second particle filter element.

10. The exhaust-gas aftertreatment system as claimed in claim 7, wherein the control element is a motor-actuable or pneumatically actuable flap or a valve.

11. The exhaust-gas aftertreatment system as claimed in claim 7, wherein the control element is located at a pipe switch of the exhaust line arranged upstream or downstream of the parallel connection of the first and second particle filter elements.

12. The exhaust-gas aftertreatment system as claimed in claim 7, further comprising an engine controller including instructions to control the control element.

13. The exhaust-gas aftertreatment system as claimed in claim 12, wherein the engine controller includes further instructions to adjust the control element to conduct exhaust-gas flow selectively to the first particle filter element at exhaust-gas temperatures below a threshold temperature.

14. The exhaust-gas aftertreatment system as claimed in claim 13, wherein the engine controller includes further instructions to adjust the control element to conduct exhaust-gas flow to the first and second particle filter elements at exhaust-gas temperatures above the threshold temperature to thereby regenerate the first and second particle filter elements.

15. A method for an engine comprising:

with an electronic controller, adjusting a control element in an exhaust-gas aftertreatment system to selectively conduct an exhaust-gas flow of the engine through a first particle filter element at temperatures below a threshold temperature;

adjusting the control element to conduct the exhaust-gas flow through a second particle filter element connected in parallel with the first particle filter element, the second particle filter element larger than the first particle filter element, at temperatures above the threshold temperature; and activating an active regeneration device coupled to the first particle filter element responsive to exceeding a soot loading threshold in the first particle filter element.

16. The method of claim 15, wherein a degree of soot loading is estimated based on air-fuel ratio and exhaust-gas temperature.

17. The method of claim 15, further comprising activating the active regeneration device responsive to exceeding a predefined soot loading density in the first filter element and exhaust-gas temperature less than 500° C.

18. The method of claim 15, further comprising controlling a temperature of the active regeneration device such that, when activated, the active regeneration device heats the first particle filter element to 500° C. or higher.

19. The exhaust-gas aftertreatment system as claimed in claim 1, wherein the exhaust line comprises a first Y-shaped piece at which the exhaust line diverges into the parallel connection of the first and second particle filter elements and a second Y-shaped piece downstream of the parallel connection of the first and second particle filter elements at which the exhaust flows through the first and second particle filter elements merge into the exhaust line.

20. The method of claim 15, wherein the control element is situated at a Y-shaped pipe switch of an exhaust line, the Y-shaped pipe switch arranged either upstream or downstream of the parallel connection of the first and second particle filter elements, wherein a first limb of the Y-shaped pipe switch forms an exhaust-gas inflow to the parallel connection of the first and second particle filter elements or an exhaust-gas outflow from the parallel connection of the first and second particle filter elements, wherein a second limb of the Y-shaped pipe switch forms an inflow or outflow of the first particle filter element, and wherein a third limb of the Y-shaped pipe switch forms an inflow or outflow of the second particle filter element.

* * * * *